US008807689B2

(12) United States Patent
Hori et al.

(10) Patent No.: US 8,807,689 B2
(45) Date of Patent: Aug. 19, 2014

(54) IMAGE RECORDING DEVICE, IMAGE RECORDING METHOD

(71) Applicant: Seiko Epson Corporation, Tokyo (JP)

(72) Inventors: Naoki Hori, Nagano (JP); Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 31 days.

(21) Appl. No.: 13/683,472

(22) Filed: Nov. 21, 2012

(65) Prior Publication Data

US 2013/0135379 A1 May 30, 2013

(30) Foreign Application Priority Data

Nov. 25, 2011 (JP) ..... 2011-257504

(51) Int. Cl.
*B41J 15/16* (2006.01)
*B41J 29/38* (2006.01)
*B41J 11/00* (2006.01)

(52) U.S. Cl.
CPC ..... *B41J 15/16* (2013.01); *B41J 11/002* (2013.01); *B41J 15/165* (2013.01)
USPC ..... 347/16

(58) Field of Classification Search
CPC .... B41J 15/16; G03G 15/652; B15H 23/1888
USPC ..... 347/16
See application file for complete search history.

(56) References Cited

U.S. PATENT DOCUMENTS

| | | | | |
|---|---|---|---|---|
| 6,641,314 | B2 * | 11/2003 | Mogi | 400/120.01 |
| 6,741,830 | B2 | 5/2004 | Kinoshita et al. | |
| 2003/0234851 | A1 * | 12/2003 | Booth et al. | 347/104 |
| 2008/0031655 | A1 * | 2/2008 | Kondo | 399/123 |
| 2010/0194812 | A1 * | 8/2010 | Castells et al. | 347/16 |
| 2012/0013670 | A1 * | 1/2012 | Toya | 347/16 |

FOREIGN PATENT DOCUMENTS

| | | | | |
|---|---|---|---|---|
| JP | 10-086472 | A | 4/1998 | |
| JP | 4328043 | B2 | 9/2009 | |
| WO | WO 2011/064136 | A1 * | 6/2011 | B65H 23/188 |

* cited by examiner

*Primary Examiner* — Stephen Meier
*Assistant Examiner* — Alexander D Shenderov
(74) *Attorney, Agent, or Firm* — Global IP Counselors, LLP

(57) ABSTRACT

An image recording device includes: a conveyor unit for conveying a recording medium along a conveyance pathway of the recording medium by rotating a first drive roller and a second drive roller provided to the conveyance pathway; a recording unit for recording an image onto the recording medium in a first region between the first drive roller and the second drive roller on the conveyance pathway; and a control unit for applying a first tension to the recording medium in the first region by controlling the torque of the second drive roller, while also adjusting the rotational speed of the first drive roller; wherein the control unit controls the conveyor unit to thereby apply a second tension that is lower than the first tension to the recording medium in a second region on the opposite side of the first region from the second drive roller in the conveyance pathway.

14 Claims, 4 Drawing Sheets

IMAGE RECORDING DEVICE, IMAGE RECORDING METHOD

CROSS-REFERENCE TO RELATED APPLICATIONS

This application claims priority to Japanese Patent Application No. 2011-257504 filed on Nov. 25, 2011. The entire disclosure of Japanese Patent Application No. 2011-257504 is hereby incorporated herein by reference.

BACKGROUND

1. Technical Field

The present invention relates to a technology for recording an image, using a recording unit, onto a recording medium, while the recording medium is also being conveyed.

2. Background Technology

Patent Document 1 describes a recording device whereby ink is sprayed from an imprinting unit arranged between a paper conveyor unit and a paper puller unit to record an image onto a continuous sheet of paper being conveyed from the paper conveyor unit to the paper puller unit. Both the paper conveyor unit and the paper puller unit are equipped with a drive roller (conveyor rolls 9*a*, 13*a*) connected to a motor, and when each of the drive rollers rotates under the driving force from the motor, then a recording medium (the continuous sheet of paper) that has been provided between the drive rollers is conveyed along a conveyance pathway. At this time, the amount of paper feed of the drive roller on the downstream side is set so as to be somewhat greater than the amount of paper feed of the drive roller on the upstream side in the conveyance pathway. In other words, the peripheral speed of the downstream drive roller is somewhat faster than the peripheral speed of the upstream drive roller, and the recording medium is drawn tight by the downstream drive roller, whereby a tension is imparted to the recording medium.

Japanese Laid-open Patent Publication No. 10-086472 (Patent Document 1) is an example of the related art.

SUMMARY

Problems to be Solved by the Invention

However, slipping between the drive rollers and the recording medium occurs in a configuration in which, as in the recording device described above, a tension is imparted to the recording medium by the provision of a speed difference in the peripheral speeds of the two drive rollers. Also, in some cases the recording medium has vibrated between the two drive rollers, under the influence of this slipping. In such a case, there has been a possibility that a recording unit (the imprinting unit) will record an image onto the vibrating recording medium, and thus that the image cannot be recorded onto the recording medium with adequate positional accuracy.

It is an advantage of the invention, which has been contrived in view of the foregoing problems, to provide a technology for making it possible to suppress the vibration of a recording medium undergoing image recording by a recording unit, and to record an image onto the recording medium with high positional accuracy.

Means Used to Solve the Above-Mentioned Problems

In order to achieve the foregoing advantage, the image recording device includes: a conveyor unit for conveying a recording medium along a conveyance pathway of the recording medium by rotating a first drive roller and a second drive roller provided to the conveyance pathway, while the recording medium is provided between the first drive roller and the second drive roller; a recording unit for recording an image onto the recording medium in a first region between the first drive roller and the second drive roller on the conveyance pathway; and a control unit for applying a first tension to the recording medium in the first region by controlling the torque of the second drive roller, while also adjusting the conveyance speed of the recording medium by controlling the rotational speed of the first drive roller; wherein the control unit controls the conveyor unit to thereby apply a second tension that is lower than the first tension to the recording medium in a second region on the opposite side of the first region from the second drive roller in the conveyance pathway.

In order to achieve the foregoing advantage, the image recording method of the invention is an image recording method in which a recording unit records, in a first region between a first drive roller and a second drive roller provided to a conveyance pathway, an image onto a recording medium that is conveyed in association with the rotation of the first drive roller and the second drive roller while also being provided between the first drive roller and the second drive roller, the image recording method being characterized in that the rotational speed of the first drive roller is controlled to thereby adjust the conveyance speed of the recording medium, and in that the torque of the second drive roller is controlled to thereby adjust the tension of the recording medium in the first region, the tension of the recording medium in the first region being higher than the tension of the recording medium in a second region on the opposite side of the first region from the second drive roller on the conveyance pathway.

In the invention configured in this fashion (the image recording device and the image recording method), the first drive roller and the second drive roller provided to the conveyance pathway are rotated while the recording medium is provided between the first drive roller and the second drive roller, whereby the recording medium is conveyed along the conveyance pathway. Also, the recording medium, of which the conveyance speed has been adjusted by the control of the rotational speed of the first drive roller, undergoes the recording of the image from the recording unit in the first region between the first drive roller and the second drive roller. This allows for the recording unit to execute the recording of the image onto the recording medium, of which the conveyance speed has stabilized. Moreover, in the invention, the torque of the second drive roller is controlled to thereby apply the first tension to the recording medium at the first region where the recording unit carries out the image recording. That is, the two drive rollers for conveying the recording medium are not given different peripheral speeds, but rather the torque of one drive roller is controlled to thereby impart a tension to the recording medium at the first region. In the configuration of such description, the occurrence of slipping between the drive rollers and the recording medium as described above can be minimized and vibration of the recording medium can be minimized. As a result thereof, it becomes possible to record an image onto the recording medium with high positional accuracy.

In the invention, the second tension that is lower than the first tension is applied to the recording medium at the second region on the opposite side of the first region from the second drive roller on the conveyance pathway. That is, the second drive roller for which the torque control is carried out serves as a boundary, where a higher tension is applied to the first region than to the second region. In such a case, the second drive roller is operated so as to exert onto the recording medium a force that is oriented toward the second region from the first region. As such, the configuration of such description makes it possible to apply an adequate tension and stabilize the recording medium at the first region, which is where the recording unit carries out the image recording, and is thus preferable in that an image can be recorded onto the recording medium at high positional accuracy.

The above-described configuration in which the second drive roller is operated so as to exert onto the recording medium the force oriented toward the second region from the first region additionally has the following advantages. Namely, even in a case where the recording medium has torn at the second region, the torn portion of the recording medium can be kept at the second region, because the second drive roller exerts onto the recording medium the force that is oriented toward the second region from the first region. As a result thereof, for example, it becomes possible to suppress the occurrence of a problem such as where the torn portion of the recording medium moves from the second region toward the first region and comes into contact with the recording unit, thereby causing damage to the recording unit.

Herein, the image recording device can be configured so as to further include a nip roller for nipping the recording medium, against the second drive roller on the other side thereof. In the configuration of such description, even though the recording medium can be torn at the second region, the recording medium can be interposed between the second drive roller and the nip roller and thus the torn portion of the recording medium can be reliably kept at the second region.

The image recording device can be configured so as to further include a first detection unit for detecting the tension of the recording medium at the first region, wherein the control unit adjusts the first tension of the recording medium at the first region on the basis of a detection result from the first detection unit. The configuration of such description is advantageous in that the first tension of the recording medium at the first region can be precisely adjusted.

The image recording device can be configured so as to further include a second detection unit for detecting the tension of the recording medium at the second region, wherein the control unit adjusts the second tension of the recording medium at the second region on the basis of a detection result from the second detection unit. The configuration of such description is advantageous in that the second tension of the recording medium at the second region can be precisely adjusted.

The image recording device can be configured such that the conveyor unit conveys the recording medium in a direction oriented toward the second drive roller from the first drive roller.

Herein, the image recording device can be configured such that the conveyor unit has a take-up roller for taking up, in the second region, the recording medium being sent out from the second drive roller. It is particularly preferable to apply the invention to an image recording device of the configuration of such description. In other words, when a situation arises such that the recording medium is taken up by the take-up roller while warped, then there conceivably can be a case in which a shear force is applied to the recording medium and the recording medium will be torn at the second region. By contrast, in the invention, as stated above, the torn portion of the recording medium can be kept at the second region. As a result thereof, for example, it becomes possible to suppress the occurrence of a problem such as where the torn portion of the recording medium moves from the second region toward the first region and comes into contact with the recording unit, thereby causing damage to the recording unit.

The image recording device can be configured such that the control unit controls the conveyor unit and thereby imparts a third tension that is lower than the second tension to the recording medium at a third region on the opposite side of the first region from the first drive roller in the conveyance pathway. In the configuration of such description, the control unit controls the conveyor unit such that a higher tension is applied by the second region, which is downstream in the conveyance pathway, than the third region, which is upstream in the conveyance pathway. For this reason, even in a case such as where, for example, the first and second drive rollers experience a failure, then the recording medium is pulled to the higher-tension second region, and backflow of the recording medium can be suppressed. As a result thereof, the occurrence of a situation such as one in which, for example, the image having been recorded on the recording medium comes into contact with a member that is further along in the backflow and this is contaminated can be suppressed.

The image recording device can be configured such that the conveyor unit conveys the recording medium in a direction oriented toward the first drive roller from the second drive roller.

Herein, the image recording device can be configured such that the conveyor unit has a position adjustment mechanism for displacing the recording medium, which is oriented toward the second drive roller, in an orthogonal direction orthogonal to the conveyance pathway in the second region, to adjust the position of the recording medium in the orthogonal direction. It is particularly preferable to apply the invention to an image recording device of the configuration of such description. In other words, when the recording medium is displaced in the orthogonal direction orthogonal to the conveyance direction, then there conceivably can thereby be a case in which a shear force is applied to the recording medium and the recording medium will be torn in the second region. By contrast, in the invention, as stated above, the torn portion of the recording medium can be kept at the second region. As a result thereof, for example, it becomes possible to suppress the occurrence of a problem such as where the torn portion of the recording medium moves from the second region toward the first region and comes into contact with the recording unit, thereby causing damage to the recording unit.

The image recording device can be configured such that the control unit controls the conveyor unit and thereby imparts a third tension that is higher than the second tension to the recording medium at a third region on the opposite side of the first region from the first drive roller in the conveyance pathway. In the configuration of such description, the control unit controls the conveyor unit such that a higher tension is applied by the third region, which is downstream in the conveyance pathway, than the second region, which is upstream in the conveyance pathway. For this reason, even in a case such as where, for example, the first and second drive rollers experience a failure, then the recording medium is pulled to the higher-tension third region, and backflow of the recording medium can be suppressed. As a result thereof, the occurrence of a situation such as one in which, for example, the image having been recorded on the recording medium comes into contact with a member that is further along in the backflow and this is contaminated can be suppressed.

The image recording device can be configured so as to further include a third detection unit for detecting the tension of the recording medium at the third region, wherein the control unit adjusts the third tension of the recording medium in the third region on the basis of a detection result from the third detection unit. The configuration of such description is advantageous in that the third tension of the recording medium at the third region can be precisely adjusted.

The image recording device can be configured so as to further include a support member for abutting against the recording medium from the side opposite to the recording unit and for supporting the recording medium, wherein the recording unit records an image onto the recording medium being supported by the support member. The configuration of such description makes it possible for the recording medium, which undergoes the image recording by the recording unit, to be supported by the support member and to be thereby stabilized, and is preferable in that an image is recorded onto the recording medium with high positional accuracy.

The image recording device can also be configured such that a photo-curable ink is ejected to record the image on the recording medium, wherein the recording unit further includes a light irradiation unit for irradiating the recording medium supported by the support member with light to cure the ink having landed onto the recording medium, the light irradiation unit facing the support member with the recording medium interposed therebetween. It is particularly preferable to apply the invention to an image recording device of the configuration of such description. Namely, the photo-curable ink is heated up either by absorbing the irradiated light or by generating heat in association with the curing. Such heat of the ink is a cause of wrinkling of the recording medium. By contrast, in the invention, the recording medium is pressed against the support member, because the first tension is applied to the recording medium in the first region. Also, the recording medium having been pressed against the support member is irradiated with light by the light irradiation unit. As such, it becomes possible to promote the dissipation of heat to the support member from the ink on the recording medium irradiated with the light, and also possible to suppress the occurrence of wrinkling of the recording medium.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

Figure 1:
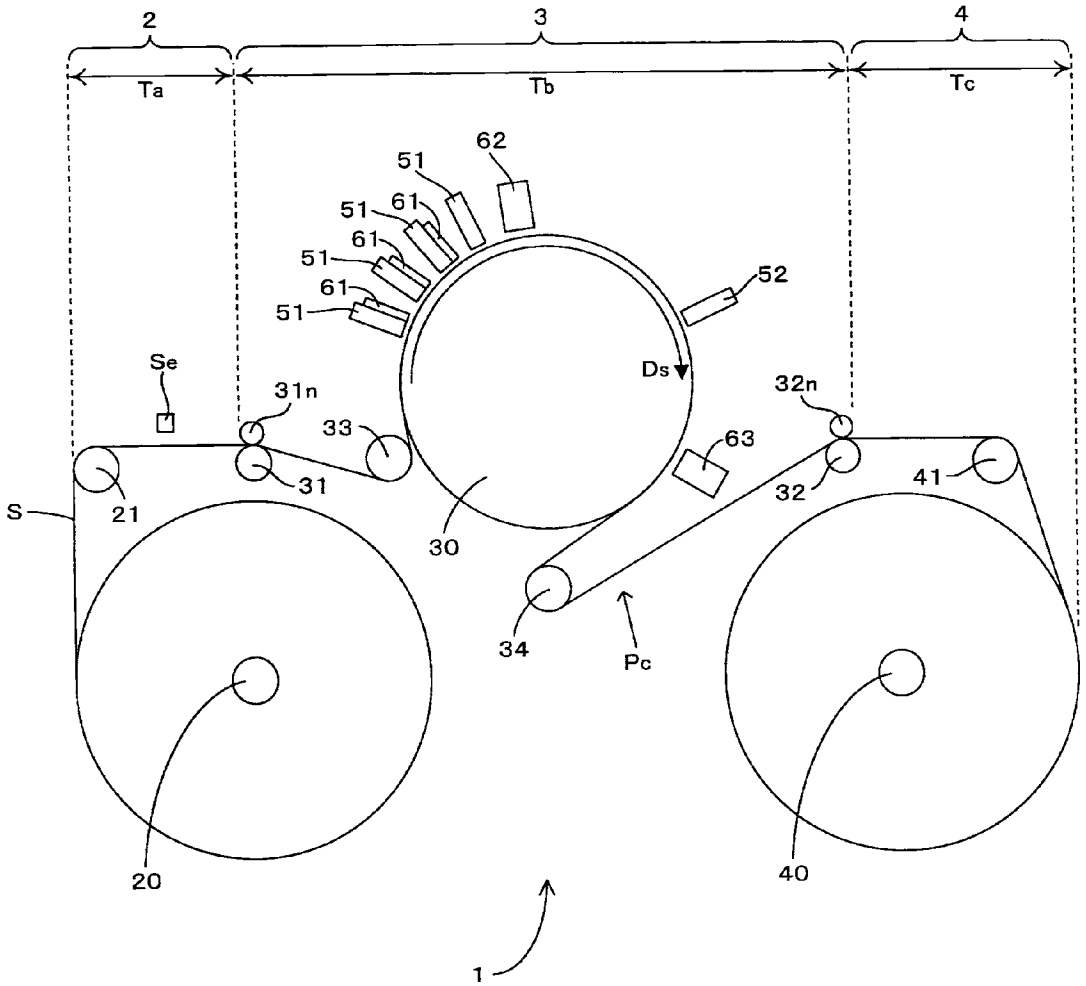
FIG. 1 is a drawing schematically illustrating an example of a device configuration provided to a printer to which the invention can be applied.

FIG. 1 is a plan view schematically illustrating an example of a configuration of a device configuration provided to a printer to which the invention can be applied. As illustrated in FIG. 1, in a printer 1, a single sheet S (web) having two ends that have been wound in a roll-shaped fashion around a supply spindle 20 and a take-up spindle 40 is fed between the supply spindle 20 and the take-up spindle 40, and the sheet S is conveyed from the supply spindle 20 to the take-up spindle 40 along a pathway Pc and is thus provided. In the printer 1, an image is recorded onto the sheet S being conveyed along the conveyance pathway Pc. The type of sheet S is largely divided into paper-based and film-based. As specific examples, paper-based includes high-quality paper, cast paper, art paper, coated paper, and the like, while film-based includes synthetic paper, PET (Polyethylene terephthalate), PP (polypropylene), and the like. In brief, the printer 1 is provided with: a supply unit 2 for supplying the sheet S from the supply spindle 20; a process unit 3 for recording an image onto the sheet S having been supplied from the supply unit 2; and a take-up unit 4 for taking up, around the take-up spindle 40, the sheet S on which the image has been recorded by the process unit 3. In the following description, whichever side of the two sides of the sheet S is the one on which the image is recorded is referred to as the "front surface", while the side opposite thereto is referred to as the "back surface".

The supply unit 2 has the supply spindle 20, around which an end of the sheet S has been wound, as well as a driven roller 21 around which is wound the sheet S having been drawn out from the supply spindle 20. The supply unit 20 supports the end of the sheet S wound therearound in a state where the front surface of the sheet S faces outward. When the supply spindle 20 is rotated in the clockwise direction in FIG. 1, the sheet S having been wound around the supply spindle 20 is thereby made to pass via the driven roller 21 and supplied to the process unit 3. It should also be noted that the sheet S is wound about the supply spindle 20 with a core tube (not shown) therebetween, the core tube being detachable with respect to the supply spindle 20. As such, when the sheet S of the supply spindle 20 has been exhausted, it is possible for a new core tube around which a roll of the sheet S has been wound to be mounted onto the supply spindle 20, to replace the sheet S of the supply spindle 20.

The process unit 3 is intended to record an image onto the sheet S by carrying out a process, as appropriate, using functional units 51, 52, 61, 62, 63 arranged along the outer peripheral surface of a platen drum 30 while the platen drum 30 supports the sheet S having been supplied from the supply unit 2. In the process unit 3, a front drive roller 31 and a rear drive roller 32 are provided on two ends of the platen drum 30, and the sheet S, which is conveyed from the front drive roller 31 to the rear drive roller 32, is supported on the platen drum 30 and undergoes image recording.

The front drive roller 31 has on the outer peripheral surface a plurality of minute projections formed by thermal spraying, and the sheet S having been supplied from the supply unit 2 is wound around from the back surface side. When the front drive roller 31 is rotated in the clockwise direction in FIG. 1, the sheet S having been supplied from the supply unit 2 is thereby conveyed downstream on the conveyance path. A nip roller 31*n* is provided to the front drive roller 31. The nip roller 31*n* is urged toward the front drive roller 31 side and in this state abuts against the front surface of the sheet S, and sandwiches the sheet S with the front drive roller 31 on the other side. This ensures the force of friction between the front drive roller 31 and the sheet S, and makes it possible for the front drive roller 31 to reliably convey the sheet S.

The platen drum 30 is a cylindrically-shaped drum rotatably supported by a support mechanism (not shown), and the sheet S being conveyed from the front drive roller 31 to the rear drive roller 32 is wound therearound from the back surface side. The platen drum 30 is intended to support the sheet S from the back surface side while also reciprocatingly rotating in a conveyance direction Ds of the sheet S, under the force of friction against the sheet S. It should also be noted that in the process unit 3, driven rollers 33, 34 for folding the sheet S on both sides of a section wound around the platen drum 30 are provided. Of these, the driven roller 33 folds the sheet S with the front surface of the sheet S wound between the front drive roller 31 and the platen drum 30. On the other hand, the driven roller 34 folds the sheet S with the front surface of the sheet S wound between the platen drum 30 and the rear drive roller 32. In this manner, the sheet S is folded upstream and downstream of the platen drum 30 in the conveyance direction Ds, whereby the length of the wound section of the sheet S on the platen drum 30 can be ensured.

The rear drive roller 32 has on the outer peripheral surface a plurality of minute projections formed by thermal spraying, and the sheet S having been conveyed from the platen drum 3 via the driven roller 34 is wound therearound from the back surface side. When the rear drive roller 32 is rotated in the clockwise direction in FIG. 1, the sheet S is thereby conveyed toward the take-up unit 4. A nip roller 32*n* is provided to the rear drive roller 32. This nip roller 32 is urged toward the rear drive roller 32 and in this state abuts against the front surface of the sheet S, and sandwiches the sheet S with the rear drive roller 32 on the other side. This ensures the force of friction between the rear drive roller 32 and the sheet S, and makes it possible for the rear drive roller 32 to reliably convey the sheet S.

In this manner, the sheet S being conveyed from the front drive roller 31 to the rear drive roller 32 is supported on the outer peripheral surface of the platen drum 30. Also, with the process unit 3, in order to record a color image onto the front surface of the sheet S being supported on the platen drum 30, a plurality of recording heads 51 corresponding to mutually different colors are provided. Specifically, four recording heads 51 corresponding to yellow, cyan, magenta, and black are lined up in the stated order of colors in the conveyance direction Ds. Each of the recording heads 51 faces the front surface of the sheet S wound around the platen drum 30, with a certain amount of clearance therebetween, and ejects ink of the corresponding color in an ink jet scheme. When each of the recording heads 51 ejects ink onto the sheet S being conveyed toward the conveyance direction Ds, a color image is thereby formed on the front surface of the sheet S.

It should be noted that the ink used is a UV (ultraviolet) ink that is cured by being irradiated with ultraviolet rays (light) (i.e., is a photo-curable ink). In view whereof, with the process unit 3, in order to cure the ink and affix same to the sheet S, UV lamps 61, 62 (light irradiation units) are provided. The execution of this curing of the ink is divided into two stages, which are temporary curing and true curing. A UV lamp 61 for temporary curing is arranged between each of the plurality of recording heads 51. Namely, the UV lamp 61 is intended to irradiate with weak ultraviolet rays and thereby cure the ink to such an extent that the shape of the ink is not lost (temporary curing), and is not intended to fully cure the ink. On the other hand, a UV lamp 62 for true curing is provided downstream in the conveyance direction Ds with respect to each of the plurality of recording heads 51. Namely, the UV lamp 62 irradiates with stronger ultraviolet rays than the UV lamp 61 and is intended to thereby fully cure the ink (true curing). Executing the temporary curing and true curing in this manner makes it possible to affix onto the front surface of the sheet S the color image formed by the plurality of recording heads 51.

Also, a recording head 52 is provided downstream in the conveyance direction Ds with respect to the UV lamp 62. This recording head 52 faces the front surface of the sheet S wound around the platen drum 30, with a certain amount of clearance therebetween, and ejects a transparent UV ink onto the front surface of the sheet S in an ink jet scheme. In other words, the transparent ink is additionally ejected onto the color image formed by the recording heads 51 of the four different colors. A UV lamp 63 is also provided downstream in the conveyance direction Ds with respect to the recording head 52. This UV lamp 63 irradiates with strong ultraviolet rays and is intended to thereby fully cure (true curing) the transparent ink having been ejected by the recording head 52. This makes it possible to affix the transparent ink onto the front surface of the sheet S.

With the process unit 3, this manner of ejecting and curing ink is executed as appropriate on the sheet S wound about the outer peripheral part of the platen drum 30, and a color image coated with the transparent ink is formed. Also, the sheet S on which the color image has been formed is conveyed toward the take-up unit 4 by the rear drive roller 32.

In addition to the take-up spindle 40 around which an end of the sheet S is wound, the take-up unit 4 also has a driven roller 41 around which the sheet S is wound from the back surface side between the take-up spindle 40 and the rear drive roller 32. The take-up spindle 40 supports one end of the sheet S taken up therearound in a state where the front surface of the sheet S is facing outward. Namely, when the take-up spindle 40 is rotated in the clockwise direction in FIG. 1, the sheet S, which has been conveyed from the rear drive roller 32, passes through the driven roller 41 and is taken up around the take-up spindle 40. It also should be noted that the sheet S is taken up around the take-up spindle 40 with a core tube (not shown) therebetween, the core tube being detachable with respect to the take-up spindle 40. As such, when the sheet S taken up around the take-up spindle 40 has been exhausted, it becomes possible to remove the sheet S in an amount commensurate with the core tube.

Figure 2:
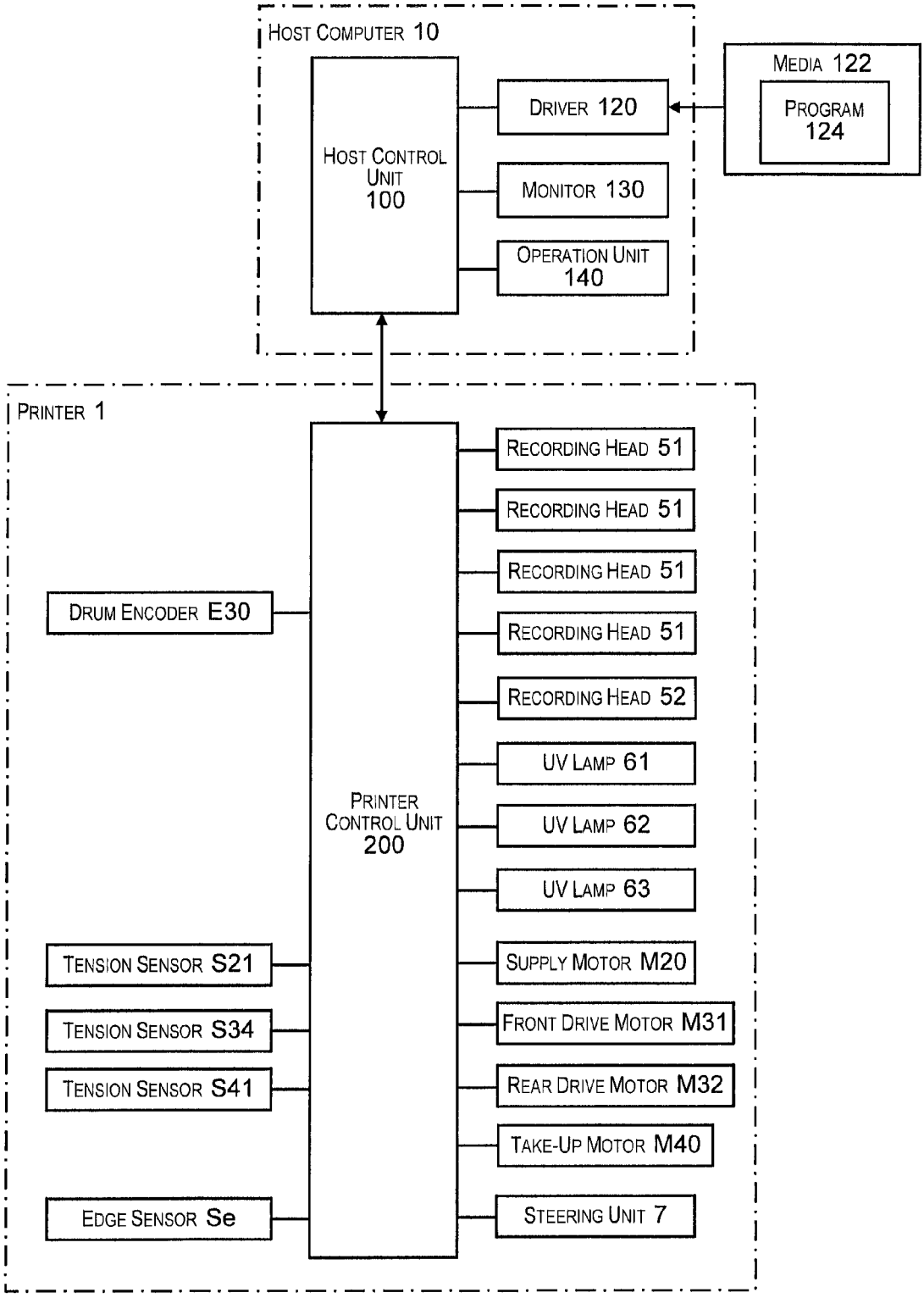
FIG. 2 is a drawing schematically illustrating an electrical configuration for controlling the printer illustrated in FIG. 1.

The foregoing is a summary of the device configuration of the printer 1. The following description shall relate to the electrical configuration for controlling the printer 1. FIG. 2 is a block diagram schematically illustrating the electrical configuration for controlling the printer illustrated in FIG. 1. The operation of the printer 1 described above is controlled by a host computer 10 illustrated in FIG. 2. With the host computer 10, a host control unit 100 for governing all control operations is constituted of a CPU (Central Processing Unit) and a memory. A driver 120 is also provided to the host computer 10, and this driver 120 reads out a program 124 from media 122. The media 122 can be a variety of different things, such as a CD (Compact Disk), DVD (Digital Versatile Disk), or USB (Universal Serial Bus) memory. The host control unit 100 also controls each of the parts of the host computer 10 and controls the operation of the printer 1, on the basis of the program 124 having been read out from the media 122.

A monitor 130 constituted of a liquid crystal display or the like and an operation unit 140 constituted of a keyboard, mouse, or the like are provided to the host computer 10 as interfaces for interfacing with an operator. In addition to an image to be printed, a menu screen is also displayed on the monitor 130. As such, by operating the operation unit 140 while also checking the monitor 130, the operator is able to open up a print setting screen from the menu screen and set the type of printing medium, the size of printing medium, the quality of printing, and a variety of other print conditions. A variety of modifications could be made to the specific configuration of the interface for interfacing with the operator; for example, a touch panel-type display can be used as the monitor 130, the operation unit 140 being then constituted of the touch panel of this monitor 130.

On the other hand, in the printer 1, a printer control unit 200 for controlling each of the parts of the printer 1 in accordance with a command from the host computer 10 is also provided. The recording heads, the UV lamps, and each of the device parts in the sheet conveyance system are controlled by the printer control unit 200. The details of the manner in which the printer control unit 200 controls each of the device parts are as follows.

The printer control unit 200 controls the ink ejection timing of each of the recording heads 51 for forming the color image, in accordance with the conveyance of the sheet S. More specifically, the control of the ink ejection timing is executed on the basis of an output (detection value) from a drum encoder E30 for detecting the rotational position of the platen drum 30, the drum encoder E30 being mounted onto a rotating shaft of the platen drum 30. Namely, because the platen drum 30 rotates reciprocatingly in association with the conveyance of the sheet S, the conveyance position of the sheet S can be ascertained when the output of the drum encoder E30 for detecting the rotational position of the platen drum 30 is referenced. In view thereof, the printer control unit 200 generates a pts (print timing signal) signal from the output of the drum encoder E30 and controls the ink ejection timing of each of recording heads 51 on the basis of the pts signal, whereby the ink having been ejected by each of the recording heads 51 is landed onto a target position on the sheet S that is being conveyed, thus forming the color image.

The timing whereby the recording head 52 ejects the transparent ink, too, is controlled by the printer control unit 200 in a similar fashion on the basis of the output of the drum encoder E30. This makes it possible for the transparent ink to be accurately ejected onto the color image having been formed by the plurality of recording heads 51. The irradiation light intensity and timing of the turning on and off of the UV lamps 61, 62, 63 are also controlled by the printer control unit 200.

The printer control unit 200 also governs a function for controlling the conveyance of the sheet S, as described in detail with reference to FIG. 1. Namely, among the members constituting the sheet conveyance system, a motor is respectively connected to the supply spindle 20, the front drive roller 31, the rear drive roller 32, and the take-up spindle 40. The printer control unit 200 controls the speed and torque of each of the motors while causing the motors to rotate, and thus controls the conveyance of the sheet S. The details of this control of the conveyance of the sheet S are as follows.

The printer control unit 200 causes a supply motor M20 for driving the supply spindle 20 to rotate, and feeds the sheet S from the supply spindle 20 to the front drive roller 31. The printer control unit 200 herein controls the torque of the supply motor M20 to adjust the tension (supply tension Ta) from the supply spindle 20 to the front drive roller 31. Namely, a tension sensor S21 for detecting the supply tension Ta is mounted onto the driven roller 21 arranged between the supply spindle 20 and the front drive roller 31. The tension sensor S21 can be constituted of for example, a load cell for detecting the force received from the sheet S. The printer control unit 200 carries out a feedback control of the torque of the supply motor M20 on the basis of a detection result from the tension sensor S21, and thus adjusts the supply tension Ta of the sheet S.

The printer control unit 200 herein carries out the supply of the sheet S while also adjusting the position of the sheet S, in the width direction (the direction orthogonal to the paper in FIG. 1), being fed out from the supply spindle 20 to the front drive roller 31. Namely, a steering unit 7 for respectively displacing the supply spindle 20 and the driven roller 21 in the axial direction (in other words, the width direction of the sheet S) is provided to the printer 1. An edge sensor Se for detecting an edge of the sheet S in the width direction is arranged between the drive roller 21 and the front drive roller 31. The edge sensor Se can be constituted of a distance sensor such as, for example, an ultrasonic sensor. The printer control unit 200 also carries out feedback control of the steering unit 7 on the basis of a detection result from the edge sensor Se, and thus adjusts the position of the sheet S in the width direction. The position of the sheet S in the width direction is thereby suitably adapted, and meandering or other instances of poor conveyance of the sheet S is thereby suppressed.

The printer control unit 200 also rotates a front drive motor M31 for driving the front drive roller 31, and a rear drive motor M32 for driving the rear drive roller 32. The sheet S having been supplied from the supply unit 2 is thereby passed through the process unit 3. Herein, speed control is executed for the front drive motor M31, whereas torque control is executed for the rear drive motor M32. In other words, the printer control unit 200 adjusts the rotational speed of the front drive motor M31 to a constant speed, on the basis of an encoder output from the front drive motor M31. The sheet S is thereby conveyed at a constant speed by the front drive roller 31.

On the other hand, the printer control unit 200 controls the torque of the rear drive motor M32 and thus adjusts the tension (process tension Tb) of the sheet S from the front drive roller 31 to the rear drive roller 32. Namely, a tension sensor S34 for detecting the process tension Tb is mounted onto the drive roller 34 arranged between the platen drum 30 and the rear drive roller 32. This tension sensor S34 can be constituted, for example, of a load cell for detecting the force received from the sheet S. The printer control unit 200 also carries out feedback control of the torque of the rear drive motor M32 on the basis of a detection result from the tension sensor S34, and thus adjusts the process tension Tb of the sheet S.

The printer control unit 200 causes a take-up motor M40 for driving the take-up spindle 40 to rotate, and the sheet S conveyed by the rear drive roller 32 is taken up around the take-up spindle 40. Herein, the printer control unit 200 controls the torque of the take-up motor M40 and thus adjusts the tension (take-up tension Tc) of the sheet S from the rear drive roller 32 to the take-up spindle 40. Namely, a tension sensor S41 for detecting the take-up tension Tc is mounted onto the drive roller 41 arranged between the rear drive roller 32 and the take-up spindle 40. This tension sensor S41 can be constituted, for example, of a load cell for detecting the force received from the sheet S. The printer control unit 200 carries out a feedback control of the torque of the take-up motor M40 on the basis of a detection result from the tension sensor S41, and thus adjusts the take-up tension Tc of the sheet S.

Figure 3:
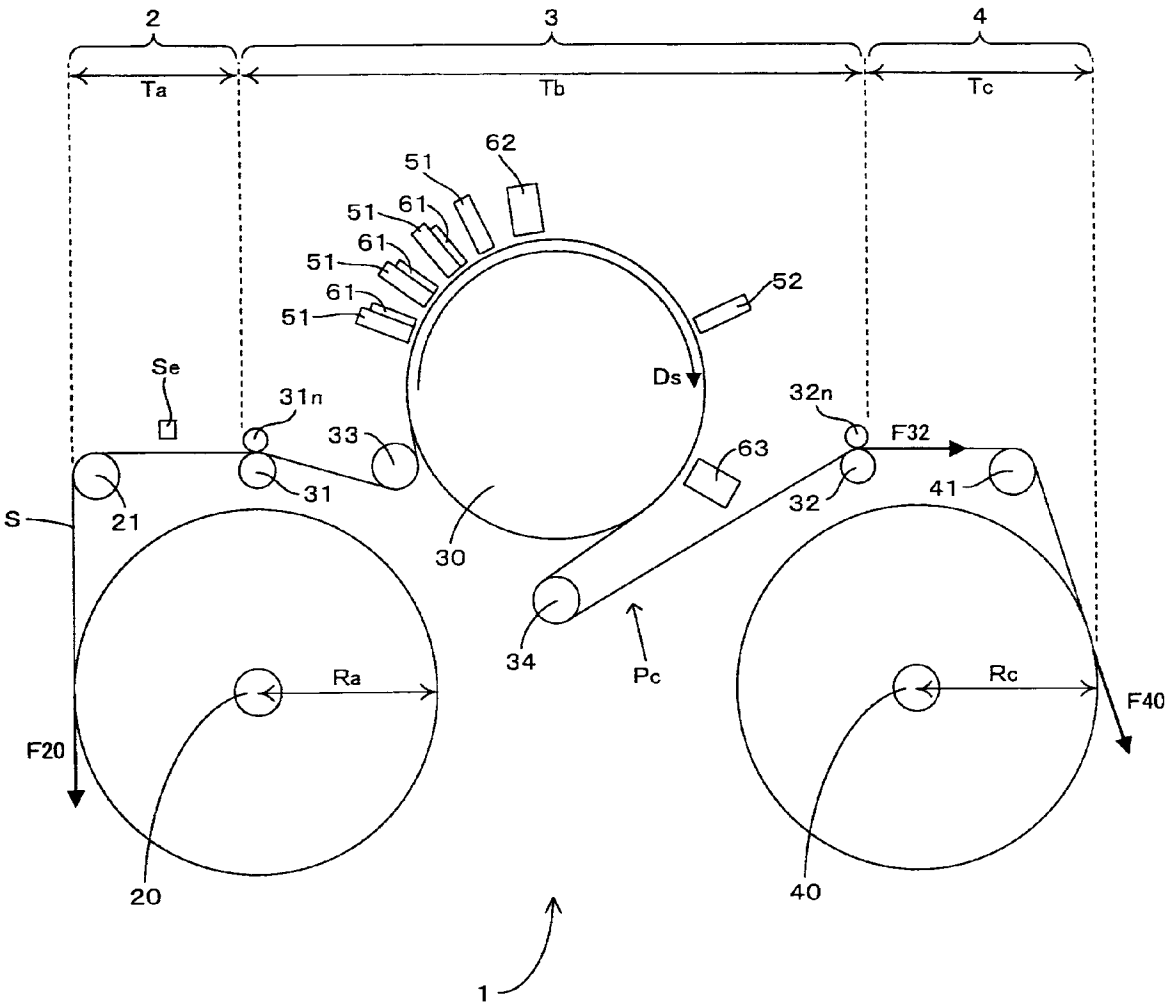
FIG. 3 is a drawing describing a conveyance control of a sheet in the first embodiment.

The foregoing is a summary of the electrical configuration for controlling the printer 1. FIG. 3 is a drawing describing the conveyance control of the sheet in the first embodiment. What follows is a more detailed description of the conveyance control of the sheet S executed by the printer control unit 200, with reference to FIG. 3. As has been described above, the front drive roller 31 rotates at a predetermined speed and the sheet S is thereby conveyed along the conveyance pathway Pc at a constant speed. The printer control unit 200 in this manner controls the conveyance speed of the sheet S to a constant speed, and thereupon adjusts the tensions Ta, Tb, Tc being applied to the sheet S.

The adjustment of the supply tension Ta is executed by adjusting the torque of the supply spindle 20. More specifically, the supply spindle 20 rotates in the clockwise direction in FIG. 3 while a force F20, which is inverse to the direction in which the sheet S is drawn out from the supply spindle 20 toward the front drive roller 31 (the conveyance direction), acts on the sheet S. At this time, the force F20 has the following relationship between the output torque tm20 of the supply motor M20 and the radius Ra of a roll composed of the sheet S that has been wound around the supply spindle 20:

$$F20=tm20/Ra$$

As such, carrying out feedback control of the output torque tm20 of the supply motor M20 on the basis of the value of the supply tension Ta detected by the tension sensor S21 makes it possible to adjust the force F20 acting on the sheet S and thus to adjust the supply tension Ta.

The rotational speed of the front drive roller 31 is adjusted to a constant, and thus the force acting on the sheet S downstream of the front drive roller 31 on the conveyance pathway Pc has no effect on the supply tension Ta. As such, the supply tension Ta will be a value equal to the force F20. That is, the following equation:

$$Ta=F20=tm20/Ra \quad \text{Equation 1}$$

is satisfied.

The adjustment of the process tension Tb is executed by adjusting the torque of the rear drive roller 32. More specifically, the rear drive roller 32 rotates in the clockwise direction in FIG. 3 while a force F32 oriented in the conveyance direction of the sheet S acts on the sheet S. Herein, the force F32 has the following relationship between the output torque tm32 of the rear drive motor M32 and the radius Rb of the rear drive roller 32:

$$F32=tm32/Rb$$

As such, carrying out feedback control of the output torque tm32 of the rear drive motor M32 on the basis of the value of the process tension Tb detected by the tension sensor S34 makes it possible to adjust the force P32 acting on the sheet S and thus to adjust the process tension Tb.

The rotational speed of the front drive roller 31 is adjusted to a constant, and thus the force acting on the sheet S upstream of the front drive roller 31 on the conveyance pathway Pc has no effect on the process tension Tb. However, as shall be described below, the take-up spindle 40 does exert a force F40 on the sheet S downstream of the rear drive roller 32 on the conveyance pathway Pc, and this force F40 does have an effect on the process tension Tb. More specifically, the process tension Tb will be a value obtained by combining the force F32 and the force F40. That is, the following equation:

$$Tb=F32+F40=tm32/Rb+F40 \quad \text{Equation 2}$$

is satisfied.

The adjustment of the take-up tension Tc is executed by adjusting the torque of the take-up spindle 40. More specifically, the take-up spindle 40 rotates in the clockwise direction in FIG. 3 while the force F40, which is oriented in the conveyance direction of the sheet S, acts on the sheet S. Herein, the force F40 has the following relationship between the output torque tm40 of the take-up motor M40 and the radius Rc of a roll composed of the sheet S having been wound around the take-up spindle 40.

$$F40=tm40/Rc$$

As such, carrying out feedback control of the output torque tm40 of the take-up motor M40 on the basis of the value of the take-up tension Tc detected by the tension sensor S41 makes it possible to adjust the force F40 acting on the sheet S and thus to adjust the take-up tension Tc. The take-up tension Tc will thereby be a value equal to the force F40. That is, the following equation:

$$Tc=F40=tm40/Rc \quad \text{Equation 3}$$

is satisfied.

The printer control unit 200 of the first embodiment thus executes the above control and thereby adjusts the tensions Ta, Tb, Tc of each of the units 2, 3, 4 of the sheet S to satisfy the following inequality:

$$Tb>Tc>Ta$$

As has been described above, in the first embodiment, the front drive roller 31 and the rear drive roller 32 are rotated while the sheet S is provided between the front drive roller 31 and the rear drive roller 32, which are provided to the conveyance pathway Pc, whereby the sheet S is conveyed along the conveyance pathway Pc. Thus, the sheet S, the conveyance speed of which has been adjusted by the control of the rotational speed of the front drive roller 31, undergoes the recording of an image from the recording heads 51 at the process unit 3 between the front drive roller 31 and the rear drive roller 32. This allows the recording heads 51 to execute the recording of an image onto the sheet S, the conveyance speed of which has been stabilized. Moreover, in the first embodiment, the torque of the rear drive roller 32 is controlled to thereby impart the process tension Tb to the sheet S at the process unit 3, which is where the recording heads 51 carry out the image recording. Namely, the two drive rollers 31, 32 for conveying the sheet S are not given different peripheral speeds, but rather the torque of the one rear drive roller 32 is controlled to thereby impart a tension to the sheet S at the process unit 3. In the configuration of such description, the occurrence of slipping between the drive rollers and the sheet S as described above can be minimized and vibration of the sheet S can be minimized. As a result thereof, it becomes possible to record an image onto the sheet S with high positional accuracy.

Also, in the first embodiment, the rear drive roller 32 for which the torque control is carried out serves as a boundary, where a higher tension Tb (>Tc) is applied to the process unit 3 than to the take-up unit 4. In such a case, the rear drive roller 32 is operated so as to exert onto the sheet S the force F32 oriented toward the take-up unit 4 from the process unit 3. The reason therefor is that the process tension Tb, which is equal to the sum of the forces F32, F40, is made to be greater than the take-up tension Tc, which is equal to the force F40, and thus the rear drive roller 32 will exert onto the sheet S the force F32, which draws the sheet S downstream in the conveyance direction (in other words, the force F32 that is oriented toward the take-up unit 4 from the process unit 3). As such, the configuration of such description makes it possible to apply an adequate tension and stabilize the sheet S at the process unit 3, where the recording heads 51 carry out the image recording, and is thus preferable in that an image can be recorded onto the sheet S at high positional accuracy.

The above-described configuration in which the rear drive roller 32 is operated so as to exert onto the sheet S the force oriented toward the take-up unit 4 from the process unit 3 additionally has the following advantages. Namely, even in a case where the sheet S has torn at the take-up unit 4, the torn portion of the sheet S can be kept at the take-up unit 4, because the rear drive roller 32 exerts onto the sheet S the force F32 oriented toward the take-up unit 4 from the process unit 3. As a result thereof, for example, it becomes possible to suppress the occurrence of a problem such as where the torn portion of the sheet S moves from the take-up unit 4 toward the process unit 3 and comes into contact with the recording heads 51, thereby causing damage to the recording heads 51.

In particular, preparing for such sheet tearing is preferable in a case where, as in the first embodiment, the sheet S being fed out from the rear drive roller 32 is taken up by the take-up spindle 40 of the take-up unit 4. In other words, when a situation arises such that the sheet S is taken up by the take-up spindle 40 while warped, then there conceivably can be a case in which a shear force is applied to the sheet S and the sheet S will be torn at the take-up unit 4. By contrast, in the first embodiment, the torn portion of the sheet S can be kept at the take-up unit 4. As a result thereof, for example, it becomes possible to suppress the occurrence of a problem such as where the torn portion of the sheet S moves from the take-up unit 4 toward the process unit 3 and comes into contact with the recording heads 51, thereby causing damage to the recording heads 51.

In the first embodiment, the nip roller 32*n* for nipping the sheet S, interposed with the rear drive roller 32 on the other side, is provided. As such, even though the sheet S can be torn at the take-up unit 4, the sheet S can be interposed between the rear drive roller 32 and the nip roller 32*n* and thus the torn portion of the sheet S can be reliably kept at the take-up unit 4.

In the first embodiment, the supply tension Ta, which is lower than the take-up tension Tc, is applied to the sheet S at the supply unit 2. In such a case, the torques of the supply motor M20 and the take-up motor M40 are controlled such that a higher tension is imparted by the take-up unit 4, which is downstream on the conveyance pathway Pc, than the supply unit 2, which is upstream on the conveyance pathway Pc. For this reason, even in a case such as where, for example, the drive rollers 31, 32 experience a failure, then the sheet S is pulled by the higher-tension take-up unit 4, and backflow of the sheet S can be suppressed. As a result thereof, the occurrence of a situation such as one in which, for example the image having been recorded on the sheet S comes into contact with a member that is further along in the backflow and this is contaminated can be suppressed.

In the first embodiment, the tension sensor S21 for detecting the supply tension Ta of the sheet S at the supply unit 2 is provided, and the supply tension Ta of the sheet S at the supply unit 2 is adjusted on the basis of the detection result from the tension sensor S21. The configuration of such description is preferable in that it is possible to accurately adjust the supply tension Ta of the sheet S at the supply unit 2.

In the first embodiment, the tension sensor S34 for detecting the process tension of the sheet S at the process unit 3 is provided, and the process tension Tb of the sheet S at the process unit 3 is adjusted on the basis of the detection result from the tension sensor S34. The configuration of such description is preferable in that it is possible to accurately adjust the process tension Tb of the sheet S at the process unit 3.

In the first embodiment, the tension sensor S41 for detecting the take-up tension Tc of the sheet S at the take-up unit 4 is provided, and the take-up tension Tc of the sheet S at the take-up unit 4 is adjusted on the basis of the detection result from the tension sensor S41. The configuration of such description is preferable in that it is possible to accurately adjust the take-up tension Tc of the sheet S at the take-up unit 4.

In the first embodiment, the platen drum 30 for abutting against the sheet S from the side opposite to the recording heads 51 and for supporting the sheet S is provided, and the recording heads 51 record an image onto the sheet S being supported by the platen drum 30. The configuration of such description makes it possible for the sheet S, which undergoes the image recording by the recording heads 51, to be supported by the platen drum 30 and to be thereby stabilized, and is preferable in that an image is recorded onto the sheet S with high positional accuracy.

In a case where, as in the first embodiment, the sheet S onto which ink has been landed is irradiated with ultraviolet rays, then it is preferable for the process tension Tb to be applied to the sheet S, as in the invention. Namely, the UV ink is heated up either by absorbing the irradiated ultraviolet rays or by generating heat in association with curing. Such heat of the UV ink is a cause of wrinkling of the sheet S. By contrast, in the first embodiment, the sheet S is pressed against the platen drum 30, because the process tension Tb is applied to the sheet S at the process unit 3. Also, the sheet S having been pressed against the platen drum 30 is irradiated with ultraviolet rays. As such, it becomes possible to promote the dissipation of heat to the platen drum 30 from the UV ink on the sheet S irradiated with the ultraviolet rays, and also possible to suppress the occurrence of wrinkling of the sheet S.

Second Embodiment

In the first embodiment described above, the speed control is executed with respect to the front drive motor M31 whereas the torque control is executed with respect to the rear drive motor M32. By contrast, in the second embodiment, the torque control is executed with respect to the front drive motor M31, and the speed control is executed with respect to the rear drive motor M32. Because the primary difference between the second embodiment and the first embodiment resides in the relationship between the speed and torque controls of the drive motors M31, M32, the description below shall center on this point of difference; like portions have been assigned like reference numerals, and a description thereof has been omitted as appropriate. However, it shall be readily understood that the second embodiment, too, being equipped with a configuration akin to that of the first embodiment, thereby gives rise to a similar effect.

Figure 4:
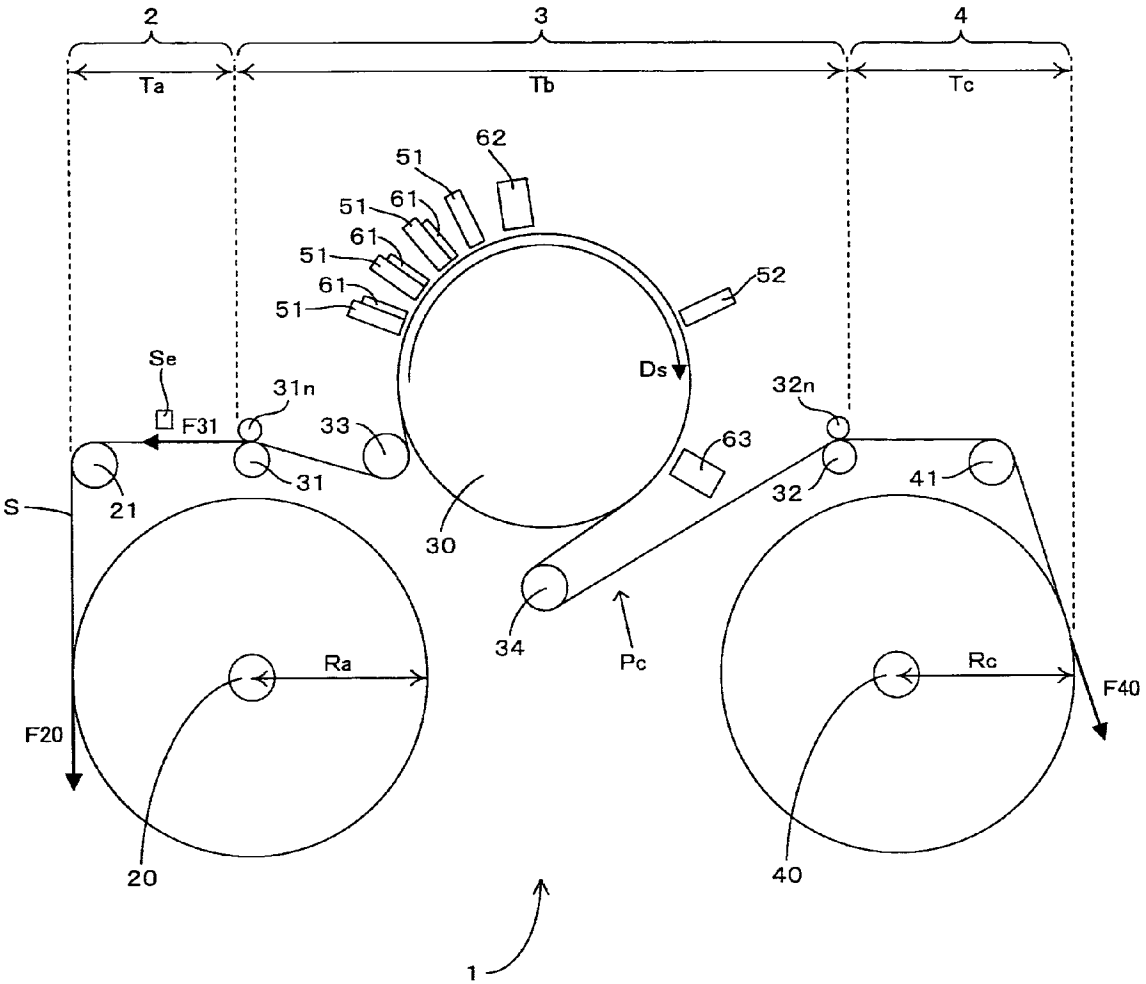
FIG. 4 is a drawing describing a conveyance control of a sheet in a second embodiment.

FIG. 4 is a drawing describing the conveyance control of the sheet in the second embodiment. In the second embodiment, the speed control is executed with respect to the rear drive motor M32, as stated above, when the sheet S is conveyed toward the rear drive roller 32 from the front drive roller 31. That is, the printer control unit 200 adjusts the rotational speed of the rear drive motor M32 to a constant on the basis of the encoder output of the rear drive motor M32. The sheet S is thereby conveyed at a constant speed by the rear drive roller 32. The printer control unit 200 in this manner controls the conveyance speed of the sheet S to a constant speed, and thereupon adjusts the tensions Ta, Tb, Tc being applied to the sheet S.

The adjustment of the supply tension Ta is executed by adjusting the torque of the supply spindle 20. More specifically, the supply spindle 20 rotates in the clockwise direction in FIG. 4 while the force F20, which is inverse to the direction in which the sheet S is drawn out from the supply spindle 20 toward the front drive roller 31 (the conveyance direction), acts on the sheet S. At this time, the force F20 has the following relationship between the output torque tm20 of the supply motor M20 and the radius Ra of a roll composed of the sheet S that has been wound around the supply spindle 20:

$$F20=tm20/Ra$$

As such, carrying out feedback control of the output torque tm20 of the supply motor M20 on the basis of the value of the supply tension Ta detected by the tension sensor S21 makes it possible to adjust the force F20 acting on the sheet S and thus to adjust the supply tension Ta. The supply tension Ta will thereby be a value equal to the force F20. That is, the following equation:

$$Ta=F20=tm20/Ra \qquad \text{Equation 4}$$

is satisfied.

The adjustment of the process tension Tb is executed by adjusting the torque of the front drive roller 31. More specifically, the front drive roller 31 rotates in the clockwise direction in FIG. 4 while a force F31, which is oriented toward the side opposite to the conveyance direction of the sheet S, acts on the sheet S. Herein, the force F31 has the following relationship between the output torque tm31 of the front drive motor M31 and the radius Rd of the front drive roller 31:

$$F31=tm31/Rd$$

As such, carrying out feedback control of the output torque tm31 of the front drive motor M31 on the basis of the value of the process tension Tb detected by the tension sensor S34 makes it possible to adjust the force F31 acting on the sheet S and thus to adjust the process tension Tb.

The rotational speed of the rear drive roller 32 is adjusted to a constant, and thus the force acting on the sheet S downstream of the rear drive roller 32 on the conveyance pathway Pc has no effect on the process tension Tb. However, as stated above, the supply spindle 20 exerts the force F20 on the sheet S downstream of the front drive roller 31 on the conveyance pathway Pc, and this force F20 does have an effect on the process tension Tb. More specifically, the process tension Tb will be a value found by combining the force F31 and the force F20. That is, the following equation:

$$Tb=F31+F20=tm31/Rd+F20 \quad \text{Equation 5}$$

is satisfied.

The adjustment of the take-up tension Tc is executed by adjusting the torque of the take-up spindle 40. More specifically, the take-up spindle 40 rotates in the clockwise direction in FIG. 4 while the force F40, which is oriented toward the conveyance direction of the sheet S, acts on the sheet S. Herein, the force F40 has the following relationship between the output torque tm40 of the take-up motor M40 and the radius Rc of a roll composed of the sheet S having been wound around the take-up spindle 40:

$$F40=tm40/Rc$$

As such, carrying out feedback control of the output torque tm40 of the take-up motor M40 on the basis of the value of the take-up tension Tc detected by the tension sensor S41 makes it possible to adjust the force F40 acting on the sheet S and thus to adjust the take-up tension Tc.

The rotational speed of the rear drive roller 32 is adjusted to a constant, and thus the force acting on the sheet S downstream of the rear drive roller 32 on the conveyance pathway Pc has no effect on the take-up tension Tc. As such, the take-up tension Tc will be a value equal to the force F40. That is, the following equation:

$$Tc=P40=tm40/Rc \quad \text{Equation 6}$$

is satisfied.

The printer control unit 200 of the second embodiment thus executes the above control and thereby adjusts the tensions Ta, Tb, Tc of each of the units 2, 3, 4 of the sheet S to satisfy the following inequality:

$$Tb>Tc>Ta$$

As has been described above, in the second embodiment, the front drive roller 31 and the rear drive roller 32 are rotated while the sheet S is provided between the front drive roller 31 and the rear drive roller 32, which are provided to the conveyance pathway Pc, whereby the sheet S is conveyed along the conveyance pathway Pc. Thus, the sheet S, the conveyance speed of which has been adjusted by the control of the rotational speed of the rear drive roller 32, undergoes the recording of an image from the recording heads 51 at the process unit 3 between the front drive roller 31 and the rear drive roller 32. This allows the recording heads 51 to execute the recording of an image onto the sheet S, the conveyance speed of which has been stabilized. Moreover, in the second embodiment, the torque of the front drive roller 31 is controlled to thereby impart the process tension Tb to the sheet S at the process unit 3, which is where the recording heads 51 carry out the image recording. Namely, the two drive rollers 31, 32 for conveying the sheet S are not given different peripheral speeds, but rather the torque of the one front drive roller 31 is controlled to thereby impart a tension to the sheet S at the process unit 3. In the configuration of such description, the occurrence of slipping between the drive rollers and the sheet S as described above can be minimized and vibration of the sheet S can be minimized. As a result thereof, it becomes possible to record an image onto the sheet S with high positional accuracy.

Also, in the second embodiment, the front drive roller 31 for which the torque control is carried out serves as a boundary, where a higher tension Tb (>Ta) is applied to the process unit 3 than to the supply unit 2. In such a case, the front drive roller 31 is operated so as to exert onto the sheet S the force P31 oriented toward the supply unit 2 from the process unit 3. The reason therefor is that the process tension Tb, which is equal to the sum of the forces F31, F20, is made to be greater than the supply tension Ta, which is equal to the force F20, and thus the front drive roller 31 will exert onto the sheet S the force F31, which draws the sheet S upstream in the conveyance direction (in other words, the force P31 that is oriented toward the supply unit 2 from the process unit 3). As such, the configuration of such description makes it possible to apply an adequate tension and stabilize the sheet S at the process unit 3, which is where the recording heads 51 carry out the image recording, and is thus preferable in that an image can be recorded onto the sheet S at high positional accuracy.

The above-described configuration in which the front drive roller 31 is operated so as to exert onto the sheet S the force oriented toward the supply unit 2 from the process unit 3 additionally has the following advantages. Namely, even in a case where the sheet S has torn at the supply unit 2, the torn portion of the sheet S can be kept at the supply unit 2, because the front drive roller 31 exerts onto the sheet S the force F31 oriented toward the supply unit 2 from the process unit 3. As a result thereof, for example, it becomes possible to suppress the occurrence of a problem such as where the torn portion of the sheet S moves from the supply unit 2 toward the process unit 3 and comes into contact with the recording heads 51, thereby causing damage to the recording heads 51.

In particular, preparing for such sheet tearing is preferable in a case where, as in the second embodiment, the sheet S oriented toward the front drive roller 31 at the supply unit 2 is displaced in the width direction (orthogonal direction) orthogonal to the conveyance pathway Pc, and the position of the sheet S in the width direction is to be adjusted. In other words, when the sheet S is displaced in the orthogonal direction orthogonal to the conveyance pathway Pc, then there conceivably can thereby be a case in which a shear force is applied to the sheet S and the sheet S will be torn at the supply unit 2. By contrast, in the second embodiment, the torn portion of the sheet S can be kept at the supply unit 2. As a result thereof, for example, it becomes possible to suppress the occurrence of a problem such as where the torn portion of the sheet S moves from the supply unit 2 toward the process unit 3 and comes into contact with the recording heads 51, thereby causing damage to the recording heads 51.

In the second embodiment, the nip roller 31*n* for nipping the sheet S, interposed with the front drive roller 31 on the other side, is provided. As such, even though the sheet S can be torn at the supply unit 2, the sheet S can be interposed between the front drive roller 31 and the nip roller 31*n* and thus the torn portion of the sheet S can be reliably kept at the supply unit 2.

In the second embodiment, the take-up tension Tc, which is higher than the supply tension Ta, is applied to the sheet S at the take-up unit 4. In such a case, the torques of the supply motor M20 and the take-up motor M40 are controlled such that a higher tension is imparted by the take-up unit 4, which is downstream on the conveyance pathway Pc, than the supply unit 2, which is upstream on the conveyance pathway Pc. For this reason, even in a case such as where, for example, the drive rollers 31, 32 experience a failure, then the sheet S is pulled by the higher-tension take-up unit 4, and backflow of the sheet S can be suppressed. As a result thereof, the occurrence of a situation such as one in which, for example, the image having been recorded on the sheet S comes into contact with a member that is further along in the backflow and this is contaminated can be suppressed.

Other

As above, in the embodiments described above, the printer 1 is equivalent to the "image recording device" of the invention; the sheet S is equivalent to the "recording medium" of the invention; the conveyance pathway Pc is equivalent to the "conveyance pathway" of the invention; the supply spindle 20, the front drive roller 31, the rear drive roller 32, the take-up spindle 40, and the motors M20, M31, M32, M40 connected thereto act in collaboration to function as the "conveyor unit" of the invention; the printer control unit 200 is equivalent to the "control unit" of the invention; the platen drum 30 is equivalent to the "support member" of the invention; the recording heads 51, 52 are equivalent to the "recording unit" of the invention; and the UV lamps 61, 62, 63 are equivalent to the "light irradiation unit" of the invention. In the first embodiment described above, the front drive roller 31 is equivalent to the "first drive roller" of the invention and the rear drive roller 32 is equivalent to the "second drive roller" of the invention. On the other hand, in the second embodiment described above, the rear drive roller 32 is equivalent to the "first drive roller" of the invention, and the front drive roller 31 is equivalent to the "second drive roller" of the invention. In the first embodiment described above, the process unit 3 is equivalent to the "first region" of the invention; the take-up unit 4 is equivalent to the "second region" of the invention; the supply unit 2 is equivalent to the "third region" of the invention; the process tension Tb is equivalent to the "first tension" of the invention; the take-up tension Tc is equivalent to the "second tension" of the invention; the supply tension Ta is equivalent to the "third tension" of the invention; the tension sensor S34 is equivalent to the "first detection unit" of the invention; the tension sensor S40 is equivalent to the "second detection unit" of the invention; and the tension sensor S21 is equivalent to the "third detection unit" of the invention. On the other hand, in the second embodiment described above, the process unit 3 is equivalent to the "first region" of the invention; the supply unit 2 is equivalent to the "second region" of the invention; the take-up unit 4 is equivalent to the "third region" of the invention; the process tension Tb is equivalent to the "first tension" of the invention; the supply tension Ta is equivalent to the "second tension" of the invention; the take-up tension Tc is equivalent to the "third tension" of the invention; the tension sensor S34 is equivalent to the "first detection unit" of the invention; the tension sensor S21 is equivalent to the "second tension detection unit" of the invention; and the tension sensor S41 is equivalent to the "third detection unit" of the invention. Also, in the first embodiment described above, the take-up spindle 40 is equivalent to the "take-up roller" of the invention, and in the second embodiment described above, the supply spindle 20, the driven roller 21, and the steering unit 7 act in collaboration to function as the "position adjustment mechanism" of the invention.

The invention is not to be limited to the embodiments described above; rather, a variety of different modifications can be added to what has been described above, provided that there is no departure from the spirit of the invention. For example, in the embodiments described above, there was a feedback control of the tension of the sheet S on the basis of the detected values from the tension sensors S21, S34, S41. However, the tension of the sheet S can also be controlled by an aspect other than feedback control.

The installation positions of the tension sensors can also be modified, as appropriate, from the embodiments described above with respect to the feedback control. To provide a more specific example, a tension sensor for detecting the process tension Tb at the process unit 3 can also be provided to the driven roller 33.

The specific configuration of the position adjustment mechanism for adjusting the position of the sheet S in the width direction is also not limited to what is described above; modifications as appropriate are possible. As such, the position adjustment mechanism can also be constituted, for example, of a meandering control device as set forth in Japanese Patent No. 4328043 or the like.

Also, in the embodiments described above, the "recording unit" of the invention was constituted of the recording heads 51, 52 for ejecting UV ink. However, the specific configuration of the recording unit is not limited thereto.

What is claimed is:

1. An image recording device, comprising:

a conveyor unit configured and arranged to convey a recording medium along a conveyance pathway of the recording medium by rotating a first drive roller and a second drive roller provided to the conveyance pathway;

a recording unit configured and arranged to record an image onto the recording medium in a first region between the first drive roller and the second drive roller on the conveyance pathway;

a control unit configured to apply a first tension to the recording medium in the first region by controlling the torque of the second drive roller, while also adjusting the conveyance speed of the recording medium by controlling the rotational speed of the first drive roller; and a second detection unit configured and arranged to detect the tension of the recording medium in a second region on the opposite side of the first region with respect to the second drive roller in the conveyance pathway, wherein the control unit being configured to control the conveyor unit to thereby apply a second tension that is lower than the first tension to the recording medium in the second region based on a detection result from the second detection unit.

2. The image recording device as set forth in claim 1, further comprising a nip roller configured and arranged to nip the recording medium, against the second drive roller on the other side thereof.

3. The image recording device as set forth in claim 1, further comprising:

a first detection unit configured and arranged to detect the tension of the recording medium at the first region, wherein the control unit adjusts the first tension of the recording medium at the first region on the basis of a detection result from the first detection unit.

4. The image recording device as set forth in claim 1, wherein the conveyor unit conveys the recording medium in a direction oriented toward the second drive roller from the first drive roller.

5. The image recording device as set forth in claim 4, wherein the conveyor unit has a take-up roller configured and arranged to take up, at the second region, the recording medium being sent out from the second drive roller.

6. The image recording device as set forth in claim 4, the control unit controls the conveyor unit and thereby imparts a third tension that is lower than the second tension to the recording medium at a third region on the opposite side of the first region from the first drive roller in the conveyance pathway.

7. The image recording device as set forth in claim 6, further comprising a third detection unit configured and arranged to detect the tension of the recording medium at the third region, wherein the control unit adjusts the third tension of the recording medium at the third region on the basis of a detection result from the third detection unit.

8. The image recording device as set forth in claim 1, wherein the conveyor unit conveys the recording medium in a direction oriented toward the first drive roller from the second drive roller.

9. The image recording device as set forth in claim 8, wherein the conveyor unit has a position adjustment mechanism configured and arranged to displace the recording medium, which is conveyed toward the second drive roller, in a width direction of the recording medium in the second region, to adjust the position of the recording medium in the width direction.

10. The image recording device as set forth in claim 9, wherein the control unit controls the conveyor unit and thereby imparts a third tension that is higher than the second tension to the recording medium at a third region on the opposite side of the first region from the first drive roller in the conveyance pathway.

11. The image recording device as set forth in claim 1, further comprising a support member configured and arranged to abut against the recording medium from the side opposite to the recording unit and support the recording medium, wherein the recording unit records an image onto the recording medium being supported by the support member.

12. The image recording device as set forth in claim 11, further comprising a photo-curable ink being ejected to record the image on the recording medium, wherein the recording unit further includes a light irradiation unit configured and arranged to irradiate the recording medium supported by the support member with light to cure the ink having landed onto the recording medium, the light irradiation unit facing the support member with the recording medium interposed therebetween.

13. The image recording device as set forth in claim 1, further comprising a cylindrically-shaped support member configured and arranged to support the recording medium conveyed from the first drive roller to the second drive roller.

14. An image recording method comprising:

conveying a recording medium in association with rotation of a first drive roller and a second drive roller provided to a conveyance pathway; and recording an image onto the recording medium with a recording unit in a first region between the first drive roller and the second drive roller, wherein the rotational speed of the first drive roller is controlled to thereby adjust the conveyance speed of the recording medium, and the torque of the second drive roller is controlled to thereby adjust the tension of the recording medium in the first region, the tension of the recording medium in the first region being higher than the tension of the recording medium in a second region on the opposite side of the first region with respect to the second drive roller on the conveyance pathway.

* * * * *